US006763611B1

(12) United States Patent
Fusco

(10) Patent No.: US 6,763,611 B1
(45) Date of Patent: Jul. 20, 2004

(54) FOOTWEAR SOLE INCORPORATING A LATTICE STRUCTURE

(75) Inventor: Ciro Fusco, Portland, OR (US)

(73) Assignee: Nike, Inc., Beaverton, OR (US)

( * ) Notice: Subject to any disclaimer, the term of this patent is extended or adjusted under 35 U.S.C. 154(b) by 99 days.

(21) Appl. No.: 10/194,056

(22) Filed: Jul. 15, 2002

(51) Int. Cl.[7] ..... A43B 13/18; A43B 13/28
(52) U.S. Cl. ..... 36/28; 36/27; 36/25 R
(58) Field of Search ..... 36/27, 28, 25 R, 36/31, 7.1, 114, 35 R

(56) References Cited

U.S. PATENT DOCUMENTS

| | | | | | |
|---|---|---|---|---|---|
| 224,937 | A | * | 2/1880 | Mintzer | 36/7.8 |
| 898,084 | A | * | 9/1908 | Backermann | 36/7.8 |
| 4,000,566 | A | | 1/1977 | Famolare, Jr. | |
| 4,262,433 | A | | 4/1981 | Hagg et al. | |
| 4,267,648 | A | | 5/1981 | Weisz | |
| 4,283,864 | A | | 8/1981 | Lipfert | |
| 4,297,796 | A | | 11/1981 | Stirtz et al. | |
| 4,451,994 | A | | 6/1984 | Fowler | |
| 4,535,553 | A | | 8/1985 | Derderian et al. | |
| 4,536,974 | A | | 8/1985 | Cohen | |
| 4,611,412 | A | * | 9/1986 | Cohen | 36/28 |
| 4,707,934 | A | * | 11/1987 | Hart | 36/7.8 |
| 4,753,021 | A | | 6/1988 | Cohen | |
| 4,774,774 | A | | 10/1988 | Allen, Jr. | |
| 4,843,741 | A | * | 7/1989 | Yung-Mao | 36/114 |
| 5,337,492 | A | * | 8/1994 | Anderie et al. | 36/28 |
| 6,115,943 | A | * | 9/2000 | Gyr | 36/35 R |
| 6,205,682 | B1 | * | 3/2001 | Park | 36/29 |
| 2001/0005947 | A1 | * | 7/2001 | Sordi | 36/102 |

* cited by examiner

*Primary Examiner*—M. D. Patterson
(74) *Attorney, Agent, or Firm*—Banner & Witcoff, Ltd.

(57) ABSTRACT

The invention is an article of footwear with a sole that incorporates a lattice structure. The lattice structure includes a plurality of connectors joined by a plurality of masses and may be configured to attenuate and distribute ground reaction forces in a specific manner. In addition, the connectors and masses may be configured to vibrate at a specific frequency or exclude vibrations at another frequency.

41 Claims, 4 Drawing Sheets

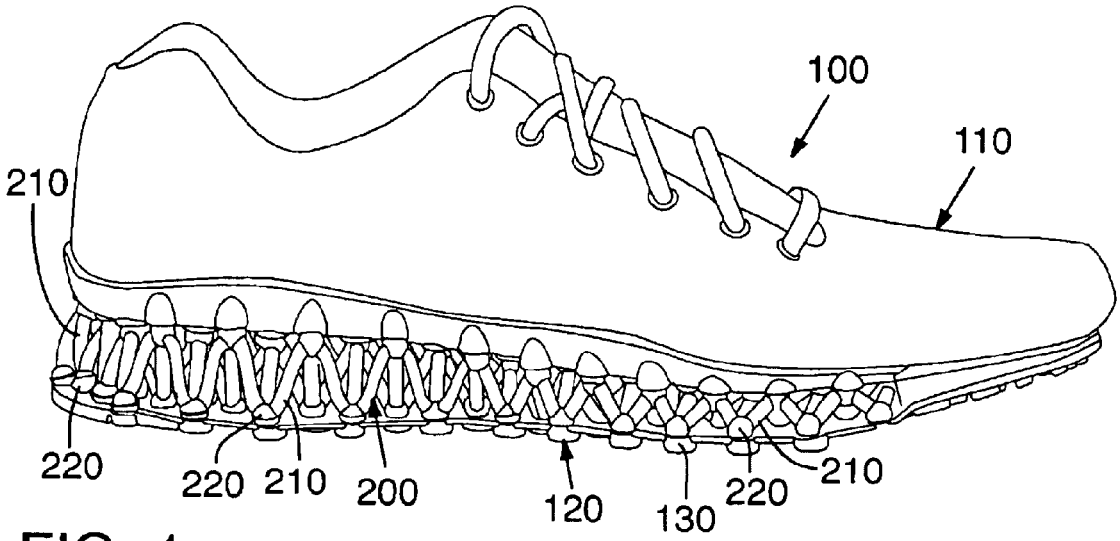
FIG. 1
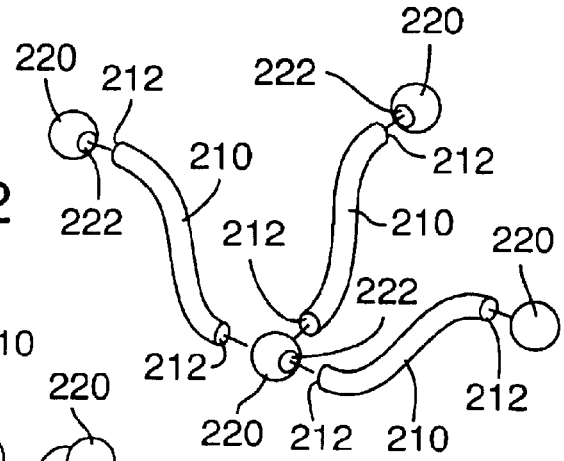
FIG. 2
FIG. 3
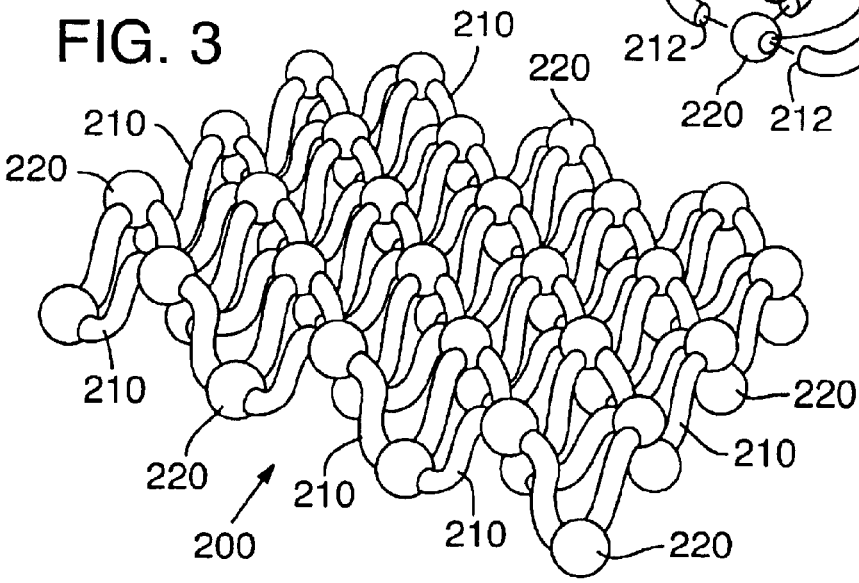

FOOTWEAR SOLE INCORPORATING A LATTICE STRUCTURE

BACKGROUND OF THE INVENTION

1. Field of the Invention

The present invention relates to sole structures for footwear. The invention concerns, more particularly, a footwear midsole that incorporates a lattice material.

2. Description of Background Art

Conventional articles of athletic footwear include two primary elements, an upper and a sole. The upper is usually formed of leather, synthetic materials, or a combination thereof and comfortably secures the footwear to the foot while providing ventilation and protection from the elements. The sole often incorporates multiple layers that are conventionally referred to as an insole, midsole, and outsole. The insole is a thin, cushioning member located adjacent to the foot that enhances footwear comfort. The midsole forms the middle layer of the sole and serves a variety of purposes that include controlling potentially harmful foot motions, such as over pronation; shielding the foot from excessive ground reaction forces; and beneficially utilizing such ground reaction forces for higher jumping or more efficient toe-off. In order to achieve these purposes, the midsole may have a variety of configurations, as discussed in greater detail below. The outsole forms the ground-contacting element of footwear and is usually fashioned from a durable, wear resistant material that includes texturing to improve traction.

The primary element of a conventional midsole is a resilient, polymer foam material, such as polyurethane or ethylvinylacetate, that extends throughout the length of the footwear and is structured to have greater thickness in the heel region of the footwear. The properties of the foam midsole are primarily dependent upon factors that include the dimensional configuration of the midsole, the material selected for the polymer foam, and the density of the midsole material. By varying these factors throughout the midsole, the relative stiffness, degree of ground reaction force attenuation, and vibrational frequency may be altered to meet the specific demands of the activity for which the footwear is intended to be used.

In general, stiffness, ground reaction force attenuation, and vibrational frequency are related properties of a foam midsole. An increase in stiffness, for example, results in a decrease in the degree of ground reaction force attenuation and an increase in vibrational frequency of the midsole. Accordingly, relatively compliant foam midsoles have a high degree of ground reaction force attenuation and low vibrational frequency. Although high ground reaction force attenuation is a desirable quality for footwear, compliant midsoles often return little energy, thereby imparting a non-energetic feel to the footwear. Consequently, footwear manufacturers attempt to design midsoles so as to achieve a suitable balance between stiffness and degree of ground reaction force attenuation.

Conventional foam midsoles, which have a suitable stiffness/ground reaction force attenuation balance, typically vibrate at frequencies between 10 and 20 Hertz. The vibrational frequency of foam midsoles has an effect upon joints, including the ankles and knees. In general, higher frequencies, particularly above 30 Hertz, induce greater stresses in the joints whereas lower frequencies induce lesser stresses. Accordingly, the vibrational frequency of a foam midsole is generally considered when providing a balance between stiffness and ground reaction force attenuation.

In addition to foam materials, conventional midsoles may include, for example, stability devices that resist over-pronation and moderators that distribute ground reaction forces. The use of foam midsole materials in athletic footwear, while providing protection against ground reaction forces, may introduce instability that contributes to a tendency for over-pronation. Pronation is the inward roll of the foot while in contact with the ground. Although pronation is normal, it may be a potential source of foot and leg injury, particularly if it is excessive. Stability devices are often incorporated into foam midsoles to control pronation of the foot. Examples of stability devices are found in U.S. Pat. No. 4,255,877 to Bowerman; U.S. Pat. No. 4,287,675 to Norton et al.; U.S. Pat. No. 4,288,929 to Norton et al.; U.S. Pat. No. 4,354,318 to Frederick et al.; U.S. Pat. No. 4,364,188 to Turner et al.; U.S. Pat. No. 4,364,189 to Bates; and U.S. Pat. No. 5,247,742 to Kilgore et al. In addition to increasing the tendency for over-pronation, conventional foam midsoles exhibit localized ground reaction force distributions. That is, foam midsoles often distribute ground reaction forces only to the area immediately adjacent to the point of impact, thereby transferring the ground reaction forces to the portion of the foot located generally above the point of impact. In order to distribute ground reaction forces to a greater portion of the midsole and foot, foam midsoles may incorporate moderators. An example of a moderator is a fluid-filled bladder, as disclosed by U.S. Pat. No. 4,183,156 and U.S. Pat. No. 4,219,945 to Marion F. Rudy.

SUMMARY OF THE INVENTION

The present invention relates to an article of footwear having an upper for receiving a foot of a wearer and a sole attached to the upper. The sole is located generally below the foot and includes a three-dimensional, compressible, semi-rigid lattice structure having a plurality of connectors joined by a plurality of masses. The physical and material properties of the connectors and the masses may be configured such that ground reaction forces incident the lattice structure are attenuated and distributed substantially throughout the lattice structure.

The connectors of the lattice structure may be straight, curved, or x-shaped, for example. Similarly, the connectors may have a variety of lengths and cross-sectional shapes. The masses may be generally spherical or may have a variety of other shapes within the scope of the present invention. Accordingly, the lattice structure may be formed of a variety of types of connectors and masses, thereby imparting a variety of lattice structure configurations that each have different properties.

By varying the configuration of the lattice structure, the degree of ground reaction force attenuation, the manner in which ground reaction forces are distributed, and the vibrational frequency of the lattice structure may be selected to achieve a specific purpose. For example, the ground reaction force distribution and vibrational frequency of the lattice structure may be configured to mimic the response of barefoot running, but with the attenuated ground reaction forces. That is, the lattice structure could be designed to impart the feeling of barefoot running, but with a reduced level of ground reaction forces. Additionally, the ground reaction forces could be more concentrated in the medial portion of the foot than in the lateral portion of the foot, thereby imparting greater stability or reducing the probability that the foot will over-pronate.

Although the sole may include a uniform lattice structure that extends from the forefoot area to the heel area, the lattice structure may have a non-uniform structure. Accordingly, the configuration of the connectors and masses may be changed depending upon the area of the foot that each portion of the lattice structure corresponds with. In addition, the lattice structure may be formed of two or more blocks that are separated to prevent vibrations from one block from interfering with the vibrations of an adjacent block.

The lattice structure may be used independent of a conventional outsole such that the lattice structure directly contacts the ground. To reduce wear and provide traction, portions of the lattice structure, such as the masses, may include caps. In addition, a perforated membrane may be used to prevent debris from becoming trapped within interstitial areas of the lattice structure.

The advantages and features of novelty characterizing the present invention are pointed out with particularity in the appended claims. To gain an improved understanding of the advantages and features of novelty, however, reference may be made to the following descriptive matter and accompanying drawings that describe and illustrate various embodiments and concepts related to the invention.

DESCRIPTION OF THE DRAWINGS

The foregoing Summary of the Invention, as well as the following Detailed Description of the Invention, will be better understood when read in conjunction with the accompanying drawings.

FIG. 1 is a lateral elevational view of an article of footwear that incorporates a lattice structure in accordance with a first embodiment of the present invention.

FIG. 2 is an exploded view of a portion of the lattice structure depicted in FIG. 1.

FIG. 3 is a perspective view of a portion of the lattice structure depicted in FIG. 1.

DETAILED DESCRIPTION OF THE INVENTION

Figure 4:
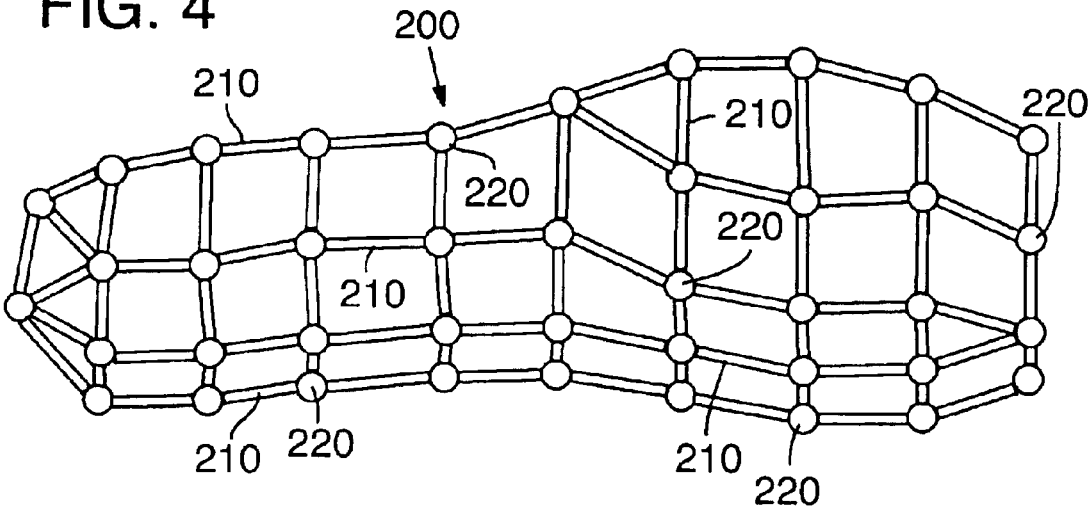
FIG. 4 is a top plan view of a portion of a lattice structure with a non-uniform mass distribution.

Referring to the drawings, wherein like numerals indicate like elements, an article of footwear 100 having a sole in accordance with the present invention is disclosed. Footwear 100 is depicted as an article of athletic footwear, particularly a running shoe. The concepts and features associated with footwear 100 may, however, be applied to any style of footwear, including a walking shoe, tennis shoe, basketball shoe, cross-training shoe, sandal, hiking boot, or work boot, for example. Accordingly, one skilled in the relevant art may apply the concepts discussed and depicted herein to a variety of foot wear styles that are suitable for a variety of activities.

The primary elements of footwear 100 are an upper 110, which may be of any conventional style, and a sole 120. The function of upper 110 is to provide a comfortable and breathable structure that secures footwear 100 to a foot of a wearer. Sole 120 is attached to a lower portion of upper 110 and is positioned between the foot and the ground.

In a first embodiment of footwear 100, depicted in FIGS. 1 through 3, sole 120 incorporates a lattice structure 200 that extends between upper 110 and an outsole 130.

The two primary elements of lattice structure 200 are a plurality of connectors 210 that extend between and are interconnected with a plurality of masses 220. Each connector 210 is an elongated beam that includes two ends 212, each end 212 being received by an aperture 222 formed in two different masses 220, as depicted in FIG. 2. Connectors 210 and masses 220 may also be formed integral with each other such that each connector 210 includes two ends that are each formed integral with one mass 220. Connectors 210 and masses 220 may be formed integral with each other through a two-plate injection molding process, for example. In general, masses 220 are positioned either adjacent to upper 110 or adjacent to the ground, with connectors 210 extending therebetween. Accordingly, connectors 210 extend in a generally diagonal direction from an area proximal upper 210 to an area proximal the ground, thereby supporting the weight of the wearer. When multiple connectors 210 are connected to multiple masses 220, as depicted in FIG. 3, a three-dimensional, interconnected lattice structure 200 is formed.

Arranging connectors 210 and masses 220 in this manner provides a sole 120 that exhibits a specialized response to ground reaction forces. A first aspect of the specialized response relates to the manner in which lattice structure 200 attenuates and distributes ground reaction forces. When a portion of sole 120 contacts the ground, lattice structure 200 attenuates the ground reaction forces and has the capacity to distribute the ground reaction forces throughout a substantial portion of lattice structure 200. The ground reaction forces are then transferred to corresponding portions of the foot, including those portions of the foot that are not located generally above the point of impact. Accordingly, the attenuative property of lattice structure 200 reduces the degree of ground reaction force incident upon the foot and the distributive property distributes the ground reaction forces to various portions of the foot. In essence, these properties act in tandem to reduce the peak ground reaction force experienced by the foot.

Although lattice structure 200 may be designed to evenly distribute the ground reaction forces, thereby achieving uniform transmission of ground reaction forces to all portions of the foot located adjacent to sole 120, lattice structure 200 may also be designed to achieve a non-uniform ground reaction force distribution. For example, the ground reaction force distribution of lattice structure 200 could mimic the response of barefoot running, but with attenuated ground reaction forces. That is, lattice structure 200 could be designed to impart the feeling of barefoot running, but with a reduced level of ground reaction forces. Additionally, the ground reaction forces could be more concentrated in the medial portion of the foot than in the lateral portion of the foot, thereby reducing the probability that the foot will over-pronate or imparting greater resistance to eversion and inversion of the foot. One skilled in the art will recognize that other ground reaction force distributions may be used to achieve a variety of benefits.

A second aspect of the specialized response to ground reaction forces relates to the vibrational properties of lattice structure 200. When footwear 100 impacts the ground, lattice structure 200 compresses and vibrates. The vibrational frequency of lattice structure 200 is primarily dependent upon the configuration of lattice structure 200 (e.g., the manner in which connectors 210 and masses 220 are arranged) and the mass of each individual mass 220. Accordingly, lattice structure 200 may be designed to vibrate at a specific frequency or lattice structure 200 may be designed to exclude specific frequencies (e.g., filter specific vibrational frequencies). Lattice structure 200 may also be tuned to have vibrational properties that are specific to the needs of the individual wearer or the activity for which footwear 100 is intended to be used. As noted above, lattice structure 200 may be designed to impart the feeling of barefoot running, but with a reduced level of ground reaction forces. In order to enhance sensations associated with the feeling of barefoot running, the vibrational properties of lattice structure 200 may be tuned to the vibrational frequency of the bare foot when contacting a relatively solid surface, such as the ground.

As noted in the Description of Background Art, vibrational frequencies of a midsole may have an effect upon joints, including the ankles and knees. In general, higher frequencies, particularly frequencies above 30 Hertz, induce greater stresses in the joints whereas lower frequencies induce lesser stresses. With regard to foam midsoles, designers consider the vibrational frequency when determining a balance between stiffness and ground reaction force attenuation because these properties are related. Advantageously, the frequency of vibration for lattice structures, such as lattice structure 200, is not highly dependent upon stiffness or ground reaction force attenuation. Unlike foam midsoles, lattice structure 200 may be designed to have high stiffness without high vibrational frequencies, thereby providing footwear manufacturers with a design latitude not available with foam midsoles.

In order to design lattice structure 200 to have a specific combination of ground reaction force attenuation, ground reaction force distribution, and vibrational frequency characteristics, one skilled in the art may vary numerous factors that relate to lattice structure 200, sole 120, or footwear 100 generally. Among other factors, design variables include the material composition of connectors 210 and masses 220; the geometry of connectors 210 and masses 220; the spatial distribution of masses 220; and the composition and structure of other portions of sole 120 and footwear 100. Each of these factors will be reviewed in detail in the following discussion.

The material selected for lattice structure 200 should possess sufficient durability to withstand the repetitive compressive and bending forces that are generated during running or other athletic activities. Exemplar materials include polymers such as urethane or nylon; metals such as aluminum, titanium, or lightweight alloys; or composite materials that combine carbon or glass fibers with a polymer material. Lattice structure 200 may be formed from a single material or a combination of different materials. For example, the masses 220 may be formed from a polymer whereas connectors 210 may be formed from a metal. In addition, specific regions may be formed from different materials depending upon the anticipated forces experienced by each region.

Connectors 210 and masses 220 may have a variety of geometries that affect aesthetic and structural aspects of lattice structure 200. Like the materials selected for connectors 210 and masses 220, the geometries of these components may be varied within an individual lattice structure 200. With regard to connectors 210, length, width, cross-sectional shape, and curvature are potential geometrical properties that may be varied.

FIG. 1 depicts lattice structure 200 as having a plurality of connectors 210 of varying length. This configuration provides sole 120 with greater thickness in the heel portion of footwear 100 than in the forefoot portion. Connectors 210 may also have a cross-sectional shape that is round, square, or triangular, for example. In addition, connectors 210 may be straight or curved along their longitudinal length. Masses 220 may also be altered geometrically to have a round, oval, cubic, or pyramidal shape, for example. Accordingly, connectors 210 and masses 220 may have a variety of geometrical shapes that may be chosen to impart specific aesthetic or functional properties to lattice structure 200.

The spatial arrangement of masses 220 is a third consideration in determining the properties of lattice structure 200. Masses 220 may be uniformly distributed adjacent to upper 110 and adjacent to the ground. Alternatively, masses 220 may have an non-uniform distribution, as depicted in FIG. 4, that serves to provide greater support in areas with a higher concentration of masses 220 and lesser support in areas with a lower concentration of masses 220. As discussed above, lattice structure 200 may be configured to impart greater medial support, thereby reducing the rate of pronation or limiting inversion and eversion of the foot. One manner in which this may be accomplished is by providing a greater concentration of masses 220 on the medial side of sole 120. Note, however, that the same result may be accomplished through other means, including altering the properties of connectors 210 such that the medial side of sole 120 provides greater support.

In addition to lattice structure 200, other portions of sole 120 and footwear 100, including an insole and outsole, may affect the properties of footwear 100. Articles of footwear often include an insole that lies adjacent the lower surface of the foot and imparts increased footwear comfort. The thickness and overall cushioning provided by an insole may be utilized to supplement the ground reaction force attenuation properties of lattice structure 200. In addition, sole 120 may include outsole 130.

Figure 5:
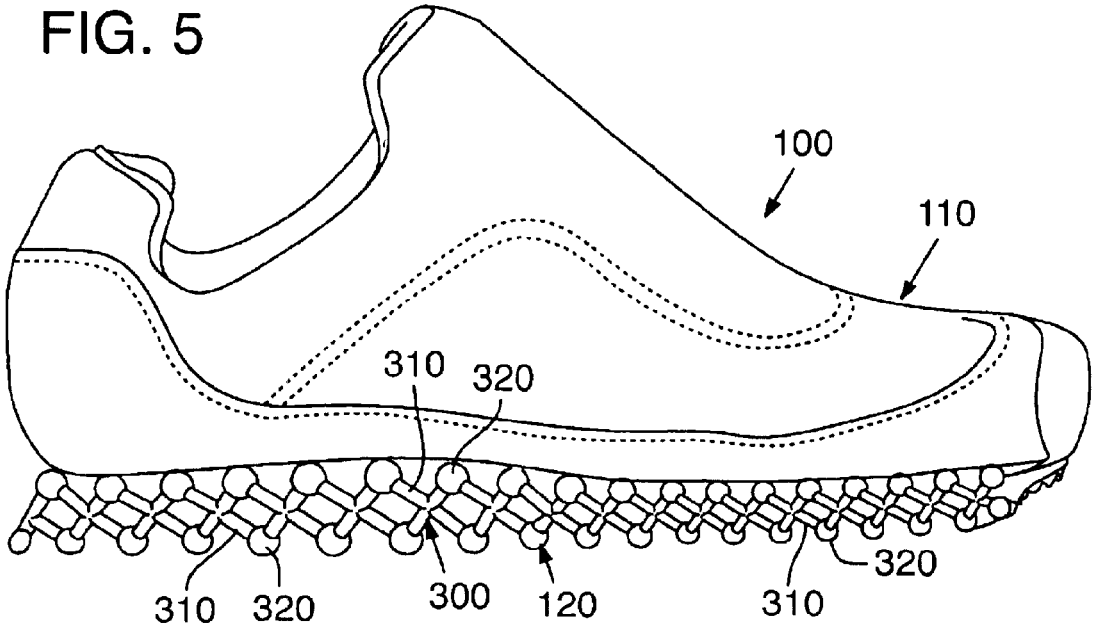
FIG. 5 is a lateral elevational view of an article of footwear that incorporates a lattice structure in accordance with a second embodiment of the present invention.
Figure 6:
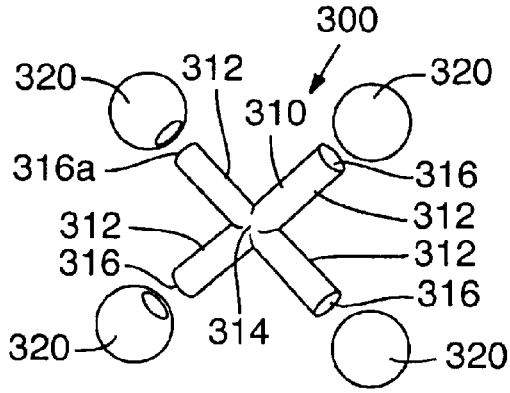
FIG. 6 is an exploded view of a portion of the lattice structure depicted in FIG. 5.
Figure 7:
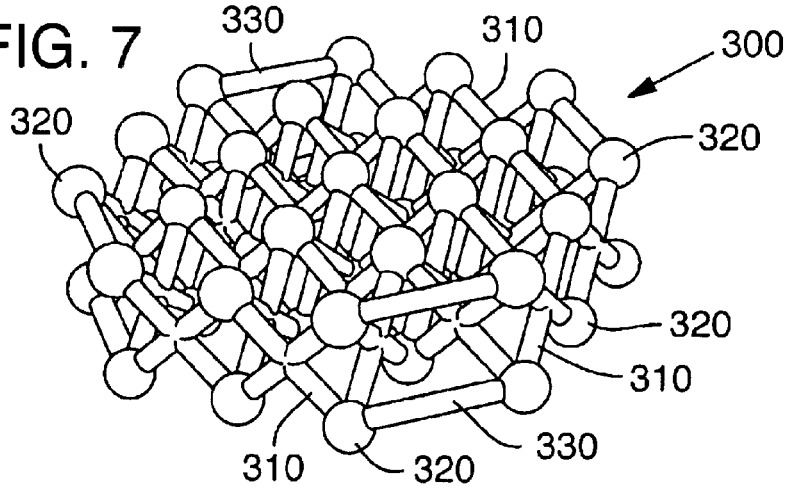
FIG. 7 is a perspective view of a portion of the lattice structure depicted in FIG. 5.

In a second embodiment of footwear 100, depicted in FIGS. 5 through 7, sole 120 incorporates a lattice structure 300 formed of a plurality of x-shaped connectors 310 that extend between are interconnected with a plurality of masses 320. Each connector 310, as depicted in FIG. 6, is formed of four extensions 312 that are connected at an intersection 314, thereby forming an x-shape. Each extension 312 includes an end 316 that is located opposite intersection 314 and connects to an individual mass 320. Each mass 320 connects to two or more connectors 310. When multiple connectors 310 are connected to multiple masses 320, a three-dimensional, interconnected lattice structure 300 is formed. In addition to connectors 310 and masses 320, lattice structure 300 may include one or more linear connectors 330 that extend directly from one mass 320 to another mass 320. Like lattice structure 200, lattice structure 300 has the capacity to attenuate ground reaction forces and distribute the ground reaction forces to various portions of lattice structure 300. Additionally, lattice structure 300 displays similar vibrational properties. Accordingly, variables such as material composition of connectors 310 and masses 320; the geometry of connectors 310 and masses 320; and the spatial distribution of masses 320 may be varied considerably to maximize the beneficial effects of lattice structure 300.

Figure 8:
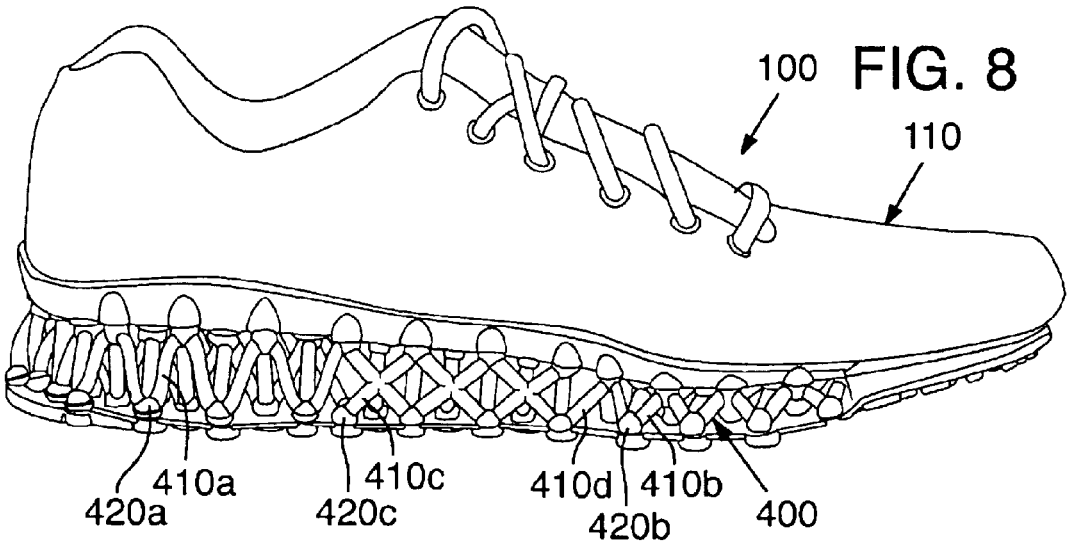
FIG. 8 is a lateral elevational view of an article of footwear that incorporates a lattice structure in accordance with a third embodiment of the present invention.

Further embodiments or variations of footwear 100 may include other lattice structure designs or various combinations of the above-disclosed designs. Note that the present invention is not limited to lattice structures having the geometry of lattice structures 200 and 300. Accordingly, lattice structures 200 and 300 are merely intended to provide an example of the many types of lattice structure configurations that fall within the scope of the present invention. A third embodiment of footwear 100, which incorporates a non-uniform lattice structure 400, is depicted in FIG. 8. Lattice structure 400 includes a plurality of connectors 410 and masses 420 that have a variety of configurations. For example, connector 410*a* may have a greater thickness and length than connector 410*b*; connector 410*c* and connector 410*d* may be formed of differing materials; and mass 420*a* and mass 420*b* may be heavier than mass 420*c*, thereby affecting vibrational properties of lattice structure 400. In addition, connector 410*a* has a curved shape whereas connector 410*b* is straight. As discussed above, changes in materials and geometry provide a means for tailoring each portion of a lattice structure to have desired characteristics.

Figure 9:
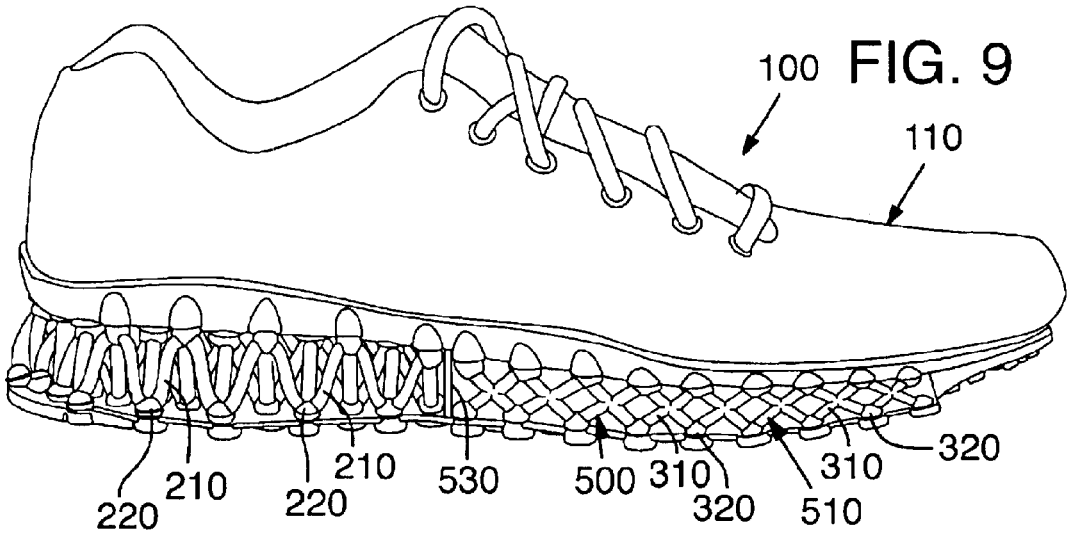
FIG. 9 is a lateral elevational view of an article of footwear that incorporates a lattice structure in accordance with a fourth embodiment of the present invention.

In a fourth embodiment of footwear 100, depicted in FIG. 9, a lattice structure 500 having a modular design is incorporated into footwear 100. That is, the lattice structure could be built in blocks (e.g., a forefoot block 510 and a heel block 520) that each have differing lattice configurations and properties. For example, forefoot block 510 could include a lattice structure similar to lattice structure 300 and heel block 520 could have a lattice structure similar to lattice structure 200. Differences in lattice structure may be utilized, for example, to provide differing vibrational or ground reaction force attenuation properties to the various regions of sole 120. To prevent vibrational interference between blocks 510 and 520, a neutral separator 530 could be located therebetween. Neutral separator 530 may be formed, for example, from a material such as DESMOPAN, a thermoplastic polyurethane manufactured by the Bayer Corporation. In addition, footwear 100 may be formed such that blocks 510 and 520 are interchangeable, thereby permitting the properties of footwear 100 to be tailored specifically to the characteristics of the wearer. For example, a relatively compliant heel block 520 may be more suitable for a light wearer than a more rigid heel block 520. Similarly, interchangeable blocks 510 and 520 permit the wearer to alter the configuration of footwear 100 for differing activities.

Figure 10:
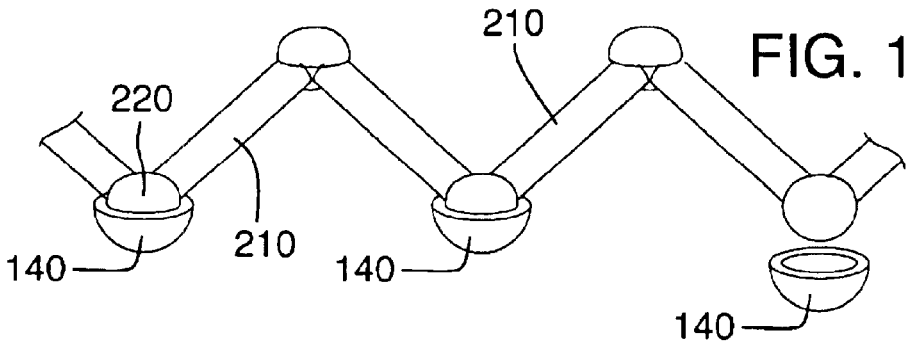
FIG. 10 is a lateral elevational view of a portion of a lattice structure that incorporates cap elements.

Traditional articles of athletic footwear include a durable outsole that makes contact with the ground and provides traction. Footwear 100 is depicted in FIG. 1 as including outsole 130, a generally traditional outsole that is attached to lattice structure 200. If an outsole is not incorporated into to footwear 100, a plurality of caps 140 may be placed over masses 220 or 320 that are located adjacent to the ground, as depicted in FIG. 10, in order to impart wear resistance and traction. Suitable materials for caps 140 include the materials that are conventionally utilized in outsoles, such as rubber. Alternatively, a perforated membrane may be added such that masses 220 or 320 project through the various perforations in the membrane. When using footwear 100 in locations where small rocks, twigs, particulates, or other debris are present, the membrane may prevent the debris from becoming lodged in sole 120.

The present invention is disclosed above and in the accompanying drawings with reference to a variety of embodiments. The purpose served by the disclosure, however, is to provide an example of the various features and concepts related to the invention, not to limit the scope of the invention. One skilled in the relevant art will recognize that numerous variations and modifications may be made to the embodiments described above without departing from the scope of the present invention, as defined by the appended claims.

That which is claimed is:

1. An article of footwear comprising:

an upper for receiving a foot of a wearer, and a sole attached to said upper and positioned generally below the foot, said sole including a three-dimensional lattice structure formed of a plurality of connectors that extend between a plurality of masses, at least a portion of said connectors extending in a longitudinal direction that corresponds with a direction between a heel region and a forefoot region of said footwear.

2. The article of footwear of claim 1, wherein a first portion of said masses are separated from a second portion of said masses by a space located between said first portion and said second portion, said connectors extending through said space to connect said first portion with said second portion.

3. The article of footwear of claim 2, wherein a first said connector has a shape of an elongated beam.

4. The article of footwear of claim 3, wherein said first said connector includes a first end and a second end, said first end being connected with one of said masses from said first portion, and said second end being connected with one of said masses from said second portion.

5. The article of footwear of claim 2, wherein said connectors include at least one x-shaped connector.

6. The article of footwear of claim 5, wherein said x-shaped connector includes two first ends and two second ends, each said first end being connected with a separate one of said masses from said first portion, and each said second end being connected with a seperate one of said masses from said second portion.

7. The article of footwear of claim 2, wherein a distance across said space is greater in the heel region of said footwear than in the forefoot region of said footwear.

8. The article of footwear of claim 1, wherein said connectors have a confisuration selected from the group consisting of straight connectors, curved connectors, and a combination of straight and curved connectors.

9. The article of footwear of claim 1, wherein said lattice structure includes a first region and a second region, said masses having a first concentration in said first region and a second concentration in said second region, said first concentration being greater than said second concentration.

10. The article of footwear of claim 9, wherein said first region is located on a medial side of said lattice structure and said second region is located on a lateral side of said lattice structure.

11. The article of footwear of claim 1, wherein said sole includes at least a first lattice structure block located in the heel region of said footwear and a second lattice structure block located in the forefoot region of said footwear.

12. The article of footwear of claim 11, wherein a separator is positioned between said first lattice structure block and said second lattice structure block.

13. The article of footwear of claim 1, wherein a portion of said masses include caps.

14. The article of footwear of claim 13, wherein said caps are formed of rubber.

15. The article of footwear of claim 1, wherein an outsole is attached to said lattice structure.

16. An article of footwear comprising:

an upper for receiving a foot of a wearer; and a sole attached to said upper and positioned generally below the foot, said sole including a three-dimensional, polymer lattice structure formed of a plurality of connectors that extend between a plurality of masses, a first portion of said masses being located adjacent said upper and separated from a second portion of said masses by a space positioned between said first portion and said second portion, said connectors extending through said space to connect said first portion with said second portion, at least a portion of said connectors having a length extending in a direction that corresponds with a longitudinal length of said footware, and at least another portion of said connectors having a length extending in a direction that corresponds with a lateral width of said footwear.

17. The article of footwear of claim 16, wherein at least one of said connectors is an elongated beam.

18. The article of footwear of claim 17, wherein said at least one of said connectors includes a first end and a second end, said first end being connected with one of said masses from said first portion, and said second end being connected with one of said masses from said second portion.

19. The article of footwear of claim 16, wherein said connectors include at least one x-shaped connector.

20. The article of footwear of claim 19, wherein said x-shaped connector includes two first ends and two second ends, each said first end being connected with a separate one of said masses from said first portion, and each said second end being connected with a separate one of said masses from said second portion.

21. The article of footwear of claim 16, wherein a distance across said space is greater in a heel region of said footwear than in a forefoot region of said footwear.

22. The article of footwear of claim 16, wherein said connectors have a configuration selected from a group consisting of straight connectors, curved connectors, and a combination of straight and curved connectors.

23. The article of footwear of claim 16, wherein said lattice structure includes a first region and a second region, said masses having a first concentration in said first region and a second concentration in said second region, said first concentration being greater than said second concentration.

24. The article of footwear of claim 23, wherein said first region is located on a medial side of said lattice structure and said second region is located on a lateral side of said lattice structure.

25. The article of footwear of claim 16, wherein said sole includes at least a first lattice structure block located in a heel portion of said footwear and a second lattice structure block located in a forefoot portion of said footwear.

26. The article of footwear of claim 25, wherein a separator is positioned between said first lattice structure block and said second lattice structure block.

27. The article of footwear of claim 16, wherein at least one of said masses includes a cap.

28. The article of footwear of claim 27, wherein said cap is formed of rubber.

29. The article of footwear of claim 16, wherein an outsole is attached to said lattice structure.

30. An article of footwear with an upper and a sole attached to said upper, said sole including a three-dimensional, polymer lattice structure, said lattice structure comprising a plurality of connectors interconnected with a plurality of masses, a first portion of said masses being located adjacent said upper and a second portion of said masses being separated from said first portion to form a space located between said first portion and said second portion, a distance across said space is greater in a heel region of said footwear than in a forefoot region of said footwear, said connectors extending through said space to connect said first portion with said second portion, said connectors including first ends and second ends, said first ends being connected with said masses from said first portion, and said second ends being connected with said masses from said second portion, at least a portion of said connectors having a length extending in a direction that corresponds with a longitudinal length of said footwear to connect said masses that are distributed at different positions along said longitudinal length, and at least another portion of said connectors having a length extending in a direction that corresponds with a lateral width of said footwear to connect said masses that are distributed at different positions along said lateral width.

31. The article of footwear of claim 30, wherein said connectors have a configuration selected from a group consisting of straight connectors, curved connectors, and a combination of straight and curved connectors.

32. The article of footwear of claim 30, wherein said connectors include at least one x-shaped connector.

33. The article of footwear of claim 30, wherein said lattice structure includes a first region and a second region, said masses having a first concentration in said first region and a second concentration in said second region, said first concentration being greater than said second concentration.

34. The article of footwear of claim 33, wherein said first region is located on a medial side of said lattice structure and said second region is located on a lateral side of said lattice structure.

35. The article of footwear of claim 30, wherein said masses include caps.

36. An article of footwear comprising:

an upper for receiving a foot of a wearer; and a sole attached to said upper, said sole including a midsole and an outsole, at least a portion of said midsole consisting essentially of a three-dimensional lattice structure extending continuously from a heel region of said footwear to a forefoot region of said footwear.

37. The article of footwear of claim 36, wherein said lattice structure includes a plurality of connectors interconnected with a plurality of masses.

38. The article of footwear of claim 37, wherein at least one of said connectors has a configuration of a straight beam.

39. The article of footwear of claim 37, wherein at least one of said connectors has a configuration of a curved beam.

40. The article of footwear of claim 37, wherein at least one of said connectors is x-shaped.

41. The article of footwear of claim 37, wherein said outsole is a plurality of caps attached to said masses.

* * * * *